United States Patent [19]

Prew, Jr.

[11] 4,187,971

[45] Feb. 12, 1980

[54] STAPLER FOR AN IMPROVED FLEXIBLE PUSHER RETRACTING MEMBER

[75] Inventor: Raymond A. Prew, Jr., Foster, R.I.

[73] Assignee: Textron Inc., Providence, R.I.

[21] Appl. No.: 920,195

[22] Filed: Jun. 29, 1978

[51] Int. Cl.[2] ..... B25C 5/16

[52] U.S. Cl. ..... 227/125; 227/128

[58] Field of Search ..... 227/125, 128, 126

[56] References Cited

U.S. PATENT DOCUMENTS 3,083,367 4/1963 Ruskin ..... 227/125

*Primary Examiner*—Paul A. Bell

*Attorney, Agent, or Firm*—Cushman, Darby & Cushman

[57] ABSTRACT

A stapler of the type having a top cover member and lever member mounted for pivotal movement between an operative position disposed in closing relation with the open top of the magazine chamber of a magazine member and a staple stick loading position displaced approximately 180°, a staple stick pusher mounted slidable on a mounting rod within the magazine chamber and a flexible elongated pusher retracting member molded of plastic material having one end portion abutting the pusher apertured to receive the rod therethrough and the opposite end formed with a disk-shaped head insertable through an elongated slot in the top cover member so as to move within a space defined by the top cover member and the lever member.

9 Claims, 6 Drawing Figures

STAPLER FOR AN IMPROVED FLEXIBLE PUSHER RETRACTING MEMBER

This invention relates to stapling devices and more particularly to improvements in stapling devices of the desk stapler type.

Desk staplers conventionally provide a magazine member which is structured to include a staple drive track in one end thereof and a staple stick receiving chamber extending from the drive track. A pusher is provided in the staple stick receiving chamber. The pusher is spring biased for movement in a direction toward the drive track so that when a staple stick is disposed in the chamber with the leading staple thereof in the drive track, the resilient bias of the pusher will serve to move the next adjacent staple of the stick into the drive track after the leading staple therein has been driven. The staple driving element of a conventional desk stapler is carried by a lever member which is pivotally mounted with respect to the magazine member at the end thereof opposite from the drive track.

One convenient arrangement for replenishing the staple stick chamber with staple sticks is to construct the magazine member so that the chamber has an open top and to effect loading by pivotally moving the lever member from a position overlying the magazine member through an arcuate extent of approximately 180° into a magazine loading position so as to expose the open top and permit the user to deposit a new staple stick therein. Various arrangements have been proposed whereby the movement of the lever member from its normal operative position into its magazine loading position is utilized to move the pusher member within the staple stick chamber of the magazine member in a direction away from the drive track so that when the stapler is in its magazine loading position the pusher is held in a retracted position, enabling the operator to deposit a new staple stick between the pusher and the drive track. One common arrangement of this type utilizes a biasing spring itself as the means for retracting the pusher.

In U.S. Pat. No. 3,083,367 there is disclosed a pusher retracting arrangement in which the retracting function is separated from the spring biasing function, the retracting function being accomplished by means of a flexible elongated element which is disclosed as being either of metal shim stock or of tear resistant plastic, such as Mylar, or of fabric, rubber, etc. As shown in the patent, the flexible element is in the form of a tape which is doubled on itself, the looped end being connected to the bight portion of a spring clip detachably fixedly mounted to the cover member connected with the lever member of the stapler. The opposite free ends of the tape are connected with the upper central portion of the pusher by a rivet extending through the pusher and the lapped free ends of the tape.

While the arrangement of the aforesaid patent is effective in operation, the manner in which the operative ends of the flexible element are connected respectively to the pusher and the cover member is relatively complex requiring relatively high costs in terms of both labor and material. For example, with respect to the connection of the folded end of the tape to the cover member, it is necessary to first connect the folded end around the bight portion of the spring clip and then to mount the spring clip within the cover member. Thus, there is involved not only the cost of providing the spring clip but two assembly operations, one in making a connection between the spring clip and the cover member. In a similar manner, the connection between the free ends of the tape and the pusher requires the provision of a separate fastening element, although the connecting procedure can be accomplished in one operation, namely, by the securement of the fastener with the tape end and pusher in assembled relation.

It is an object of the present invention to provide a stapler of the type described having a flexible pusher retracting member similar to the flexible member described above having improved end connections both with respect to the pusher and with respect to the cover member. In accordance with the principles of the present invention, this objective is achieved with respect to the pusher connection by providing an aperture in the end of the flexible member which is to be connected to the pusher and effecting an assembly of the apertured end and the pusher onto the elongated rod normally provided to mount the pusher for reciprocating movement within the staple stick chamber of the magazine member. In this way, there is no need to provide a separate fastener to effect the connection of the end of the flexible member with the pusher, nor is there any need to provide for an additional assembly operation during which such fastener is secured in position. The arrangement provides for an improved force transmittal to the pusher during operation when compared with the riveted arrangement of the prior art. With the prior art arrangement the connection between the flexible element and pusher is made by the rivet in the upper central portion of the pusher so that there is an imbalanced loading causing the pusher to cock. With the present arrangement the connection between the end of the flexible element and the pusher is one of simple abutting relationship with each having a common connection with the mounting rod. In this way the retracting forces are transmitted by the present arrangement to the pusher in such a way as to prevent an application of torque to the pusher tending to cock or tilt the same.

The above objective is achieved with respect to the connection of the flexible element with the cover member by forming on the end of the flexible element an enlarged head which extends through an elongated slot in the cover member communicating with a space between the lever member and the cover member. The enlarged head has an exterior surface configuration which permits passage of the head through the slot and into the space when the head is oriented in a mounting relation with respect to the slot. The exterior configuration of the head is such as to prevent movement of the same outwardly through the slot when the head is oriented in a normal operative relation within the space. With this arrangement it is possible to use the slot and space to accommodate movement of the entire end portion of the retracting element during the normal operation of the device as the pusher moves in a feeding direction toward the drive track. Since this movement is accommodated within this relatively large space, rather than in the limited space normally provided between the cover and the magazine member, a much thicker flexible element can be utilized. Indeed, with the present invention it is preferable to utilize a flexible member which is molded rather than fabricated from tape. By utilizing a molding operation it becomes possible to integrate the end connections in the form of the aforesaid aperture and enlarged head. In this way the costs inherent in providing separate fasteners and the assembly costs involved in utilizing such separate fasteners are completely eliminated.

Accordingly, it is a further object of the present invention to provide a stapling device of the type described having an improved pusher retracting element which is simple in construction, economical to manufacture and assemble and effective in operation.

These and other objects of the present invention will become more apparent during the course of the following detailed description and appended claims.

The invention may best be understood with reference to the accompanying drawings, wherein an illustrative embodiment is shown.

Figure 1:
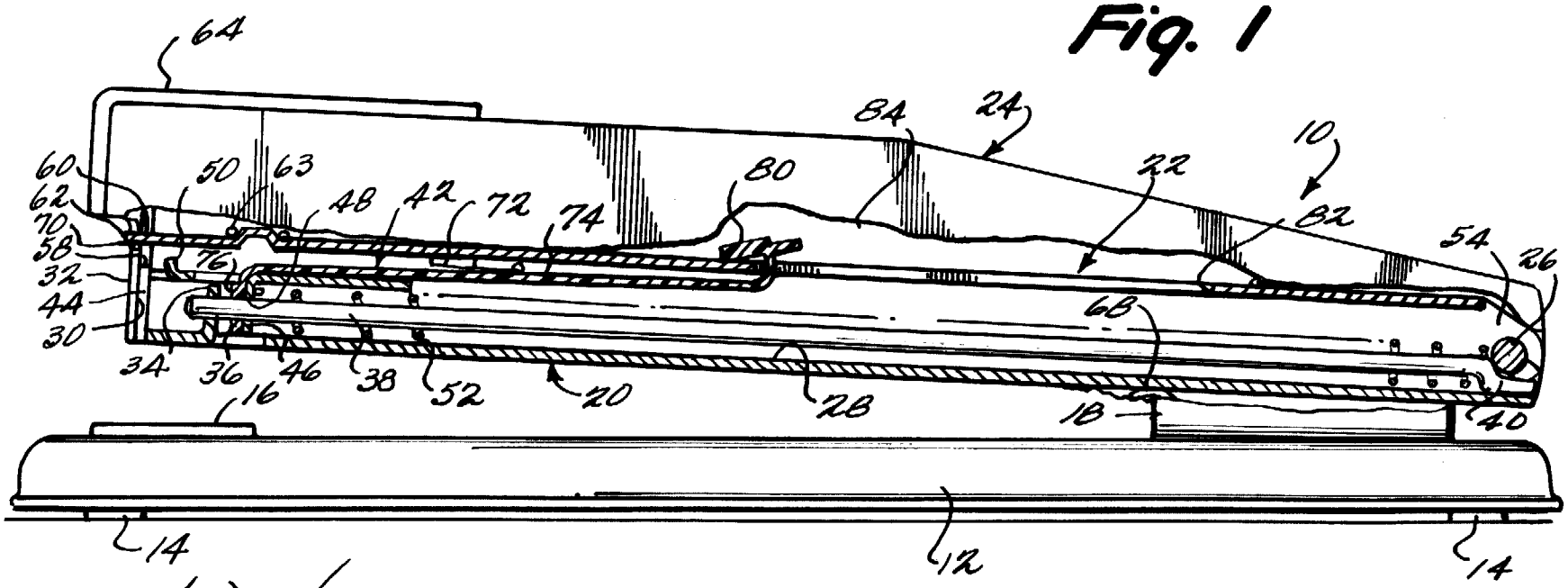
FIG. 1 is a side elevational view of a stapling device embodying the improvements of the present invention, with certain parts broken away for purposes of clearer illustration.

Referring now more particularly to the drawings, there is shown therein a stapling device in the form of a desk stapler 10 which embodies the principles of the present invention. It will be understood that the present invention has applicability to other types of stapler devices, such as plier staplers and the like, the desk stapler embodiment constituting a preferred application.

The desk stapler 10 as shown includes the usual base member 12 provided with desk top engaging pads 14 at opposite ends of the lower surface, a staple clinching anvil member 16 on the upper surface at one end thereof and a pivot yoke 18 fixed to the upper surface at the opposite end thereof. The yoke 18 forms a part of a pivot means for pivotally mounting a magazine member, generally indicated at 20, a cover member, generally indicated at 22, and a lever member, generally indicated at 24, to the base member 12 by a common pivot pin 26.

As shown, magazine member 20 is preferably of generally U-shaped cross-sectional configuration so as to define therein an elongated open top staple stick receiving chamber 28. The end of the magazine member adjacent the pivot pin 26 has the leg portions of the U-shaped configuration thereof apertured to receive the pivot pin 26 so as to effect the aforesaid pivotal connection. The end of the staple stick receiving chamber 28 remote from the pivot pin 26 leads to a staple drive track 30 formed by bending a pair of leg extensions 32 of the magazine member laterally inwardly toward one another.

The bight portion of the magazine member 20 at a position adjacent the drive track 30 has a tab 34 struck therefrom and bent upwardly. The tab is formed with a central aperture 36 for receiving therethrough one end of a pusher mounting rod 38. The opposite end of the mounting rod 38 is bent, as indicated at 40, and disposed between the pivot pin 60 and the adjacent bight portion of the magazine member 20.

Disposed within the staple stick chamber 28 of the magazine member 20 is a pusher, generally indicated at 42. The pusher is mounted for reciprocating movement within the chamber 28 toward and away from the drive track 30 by the mounting rod 38. The pusher 42, as shown, is preferably of inverted U-shaped configuration in cross-section, the forward edges of the legs, indicated at 44, serving as means for engaging the trailing end of a staple stick mounted within the chamber 28 to feed the same so that the leading staple of the staple stick is disposed within the guide track 30. The mounting of the pusher 42 on the rod 38 is preferably accomplished by means of a tab 46 struck from the bight portion of the pusher and bent downwardly at right angles. The tab 46, like the tab 34, is centrally apertured as indicated at 48 so as to receive the mounting rod therethrough. The forward edge of the bight portion of the pusher 42 has another tab struck therefrom and bent upwardly to provide a manually operable projection 50 by which an operator is enabled to effect a manual movement of the pusher within the chamber 28 along the mounting rod 38.

The pusher 42 is resiliently biased to move within the chamber 28 in a direction toward the drive track 30 by suitable spring means which, as shown, is preferably in the form of an elongated coil spring 52 disposed in surrounding relation with the mounting rod 38 with one end thereof in engagement with the pivot pin 26 and the opposite end thereof with the trailing surface of the mounting tab 46 of the pusher 42.

The cover member 22 is likewise of inverted U-shaped cross-sectional configuration, the legs of the U configuration being considerably shorter than the legs of the U configuration of either the magazine member 20 or the pusher 42. At the end of the cover member adjacent the pivot pin 26 the leg portions are enlarged to form mounting ears 54 through which the pivot pin 26 extends.

The lever member 24 is also of inverted U-shaped configuration in cross-section. Here again, the end of the lever member adjacent the pivot pin 26 has the leg portions thereof apertured to receive the pivot pin so as to effect the aforesaid pivotal connection. Fixed to the interior surface of the bight portion at the opposite end of the lever member 24 is one leg 56 of an L-shaped member having a second leg extending downwardly at right angles constituting a staple driving element 58. The staple driving element 58 is formed with an elongated opening 60 which is adapted to slidably receive therein a tab 62 formed on the adjacent end of the cover member 22. A spiraled coil spring 63 is positioned between the leg 56 and the adjacent forward section of the cover member 22. Spring 63 serves to resiliently bias the lever member and cover member apart which movement is limited by the engagement of the tab 62 within the slot 60. The exterior of the lever member 24 at the end thereof opposite from the pivot pin 26 may be provided with an appropriate actuating member 64.

In accordance with conventional practice, the pivotal movement of the magazine member with respect to the base member is limited in a direction away from the base member by a tab connection 66 between the yoke and the adjacent leg portions of the magazine member. A spring 68 serves to resiliently urge the magazine member into a normal operative limiting position spaced from the base member, the tab connection 66 accommodating movement of the magazine member from its normal operative position in a direction toward the base member until the lower portion of the magazine structure defining the drive track engages either the anvil 16 or a workpiece such as papers or the like disposed therebetween. In accordance with conventional practice, the tab connection 66 is such that the magazine can be yieldably moved in a direction away from the base member out of its normal operative position so as to permit the stapler to be used as a tacker.

The cover member 22 is releasably retained in an operative position overlying the magazine member 28. In this position the leg portion of the cover member actually extends into the upper portion of the stapler stick receiving chamber 28 and the elongated free edges thereof are disposed in overlying relation to the ends of the crowns of a staple stick disposed in operative relation within the chamber 28. In this way the cover member serves to insure that in the event the stapler is turned upsidedown the staple stick will be retained in proper operative relation within the chamber 28. Cover member 62 is also disposed in generally abutting relation with upwardly facing shoulders 70 formed in the central upper portion of the leg extensions 32 of the magazine member 20.

As shown, the means for releasably retaining the cover member in the aforesaid operative position is a spring clip 72 similar to the spring clip 76 of U.S. Pat. No. 3,083,367 which is mounted on the cover member and has releasably connection with the suitable detents in the leg portions of the magazine member 20. For further details with respect to this construction, reference can be made to the description contained in U.S. Pat. No. 3,083,367 which is hereby incorporated by reference into the present specification.

Figure 2:
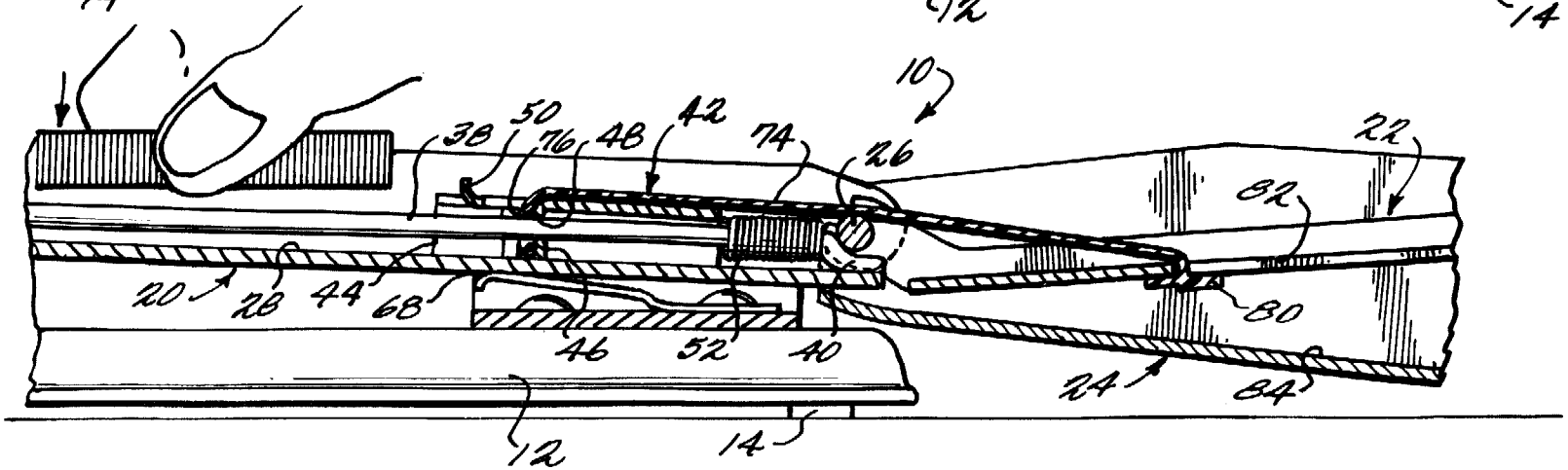
FIG. 2 is a fragmentary view of a stapling device shown in FIG. 1 illustrating the parts in vertical section disposed in their staple stick loading position.
Figure 6:
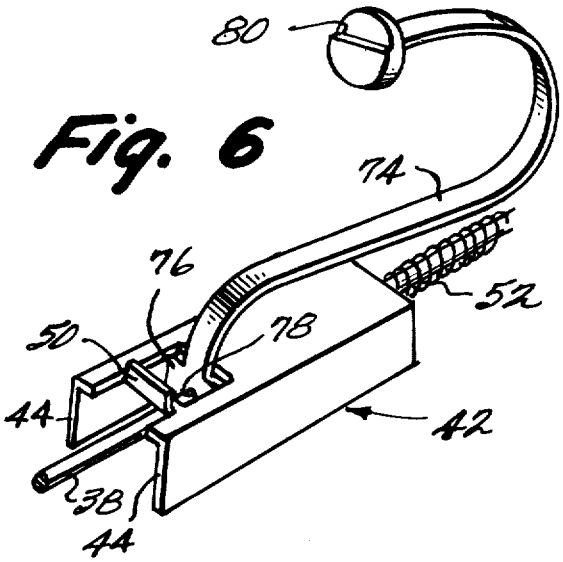
FIG. 6 is a perspective view of the pusher and flexible pusher retracting element in mounted relation with respect to the pusher mounting rod.
Figure 5:
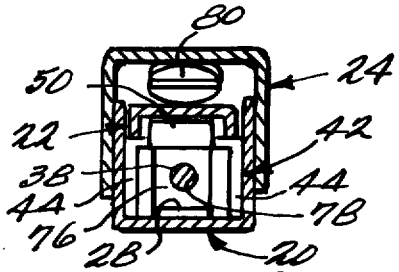
FIG. 5 is a cross-sectional view taken along the line 5—5 of FIG. 4.
Figure 4:
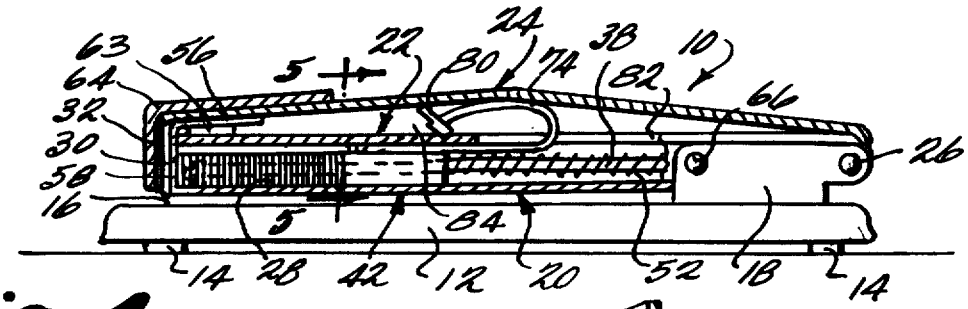
FIG. 4 is a view similar to FIG. 3 showing the position of the parts during a stapling operation, with the pusher in an intermediate position.

Cover member 22 is releasably moved away from its operative position out of retention by the spring clip 72 by simply lifting the lever member 24 in a direction upwardly with respect to the magazine member 20. The lever member and cover member are movable together through an arcuate extent of approximately 180° into a staple stick loading position as shown in FIG. 2. A staple stick loading cycle includes a magazine opening stroke during which the cover member is moved with the lever member from the operative position thereof to the staple stick loading position thereof and a magazine closing stroke during which the cover member is moved with the lever member from the staple stick loading position to the operative position thereof.

In accordance with the principles of the present invention, there is provided an improved elongated, flexible, pusher retracting means, generally indicated at 74. The elongated, flexible pusher retracting means 74 is preferably molded of a plastic material, as for example, polypropylene, in a tang-like configuration. The elongated, flexible tang member is operatively connected with the pusher 42 and the cover member 22 so as to effect movement of the pusher in a direction away from the drive track 30 into a stick loading position, as shown in FIG. 2, in response to the movement of the cover member with the lever member 24 through its magazine opening opening stroke. The arrangement also permits the pusher member 42 to be moved by the resilient bias of the spring 52 toward the drive track 30 when the cover member 22 is in its operative position.

The improvements of the present invention relate specifically to the end connections of the flexible member 74 with the pusher 42 and cover member 22. The connection with the pusher 42 is best shown in FIGS. 1, 2, 5 and 6. In these views, it will be noted that the end of the flexible member 74 connected with the pusher includes and enlarged or thickened end portion 76 having a central opening 78 formed therein of a size comparable to the size of the pusher guide rod 38 so as to receive the latter therethrough. In its operative relationship with the pusher, end portion 76 of the flexible member 74 is disposed in abutting engagement with the tab 46 of the pusher, the end portion 76 being inserted through the opening in the bight portion of the pusher formed by the tab 46. The abutting engagement of the end portion 76 with the pusher tab 46 is maintained simply by virtue of the fact that the guide rod 38 extends through the aligned apertures 48 and 78 in both of these elements.

The connection between the opposite end of the elongated flexible member 74 and the cover member 22 consists in the molding of an enlarged head portion 80 as an integral part of the flexible member 74 and the forming of an elongated slot 82 in the central bight portion of the cover member 22 which extends longitudinally and provides access to a space 84 defined by the upper surface of the cover member 22 and the contiguous interior surfaces of the lever member 24.

The manner of effecting the assembly of the flexible pusher retracting member will be readily apparent from the above description. To briefly reiterate, apertured end portion 76 is simply moved into engagement with the tab 46 so that the opening 78 in the end portion 76 is aligned with the opening 48 of the tab 46. Guide rod 38 is then assembled in the usual fashion therethrough, thus rendering this connection quite simple. The connection of the opposite end of the flexible member 74 with the cover member 22 is effected simply by feeding the head portion 80 through the slot 82 with the thickness thereof aligned with the width of the slot. After passage through the slot, the head assumes a position capturing the adjacent end of the flexible member 74 within the space 84 so that it no longer moves outwardly through the slot 82.

Figure 3:
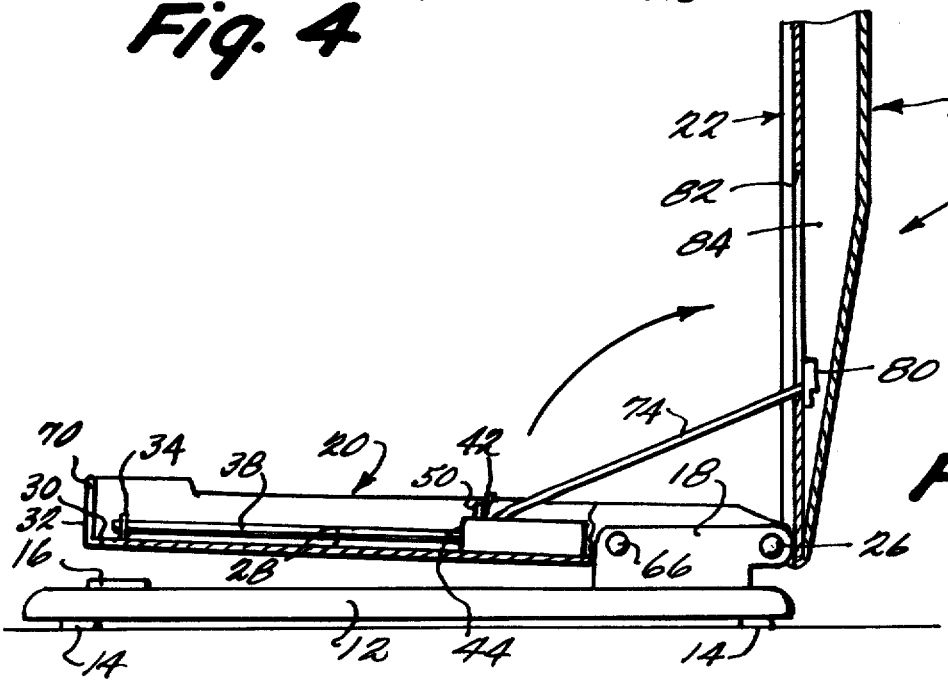
FIG. 3 is a view similar to FIGS. 1 and 2 on a reduced scale showing the position of the parts in a position intermediate the two positions shown in FIGS. 1 and 2.

FIGS. 2 and 3 illustrate the operation of the flexible pusher retracting element 74 during a staple loading cycle. FIG. 1 illustrates the condition of the stapler 10 when the magazine is depleted of staples. It will be noted that pusher 42 is disposed within the staple stick receiving chamber 28 a maximum distance forwardly and that the head portion 80 of the flexible member 74 is disposed within the space 84 at a position adjacent the forward end of the slot 82. As the lever member 24 is lifted upwardly from its operative position through the initial portion of its magazine opening stroke, the enlarged head portion 80 engages the surface of the cover member 22 surrounding the slot 82 and the flexible member 74 is thus tensioned by virtue of this engagement and the engagement of the enlarged apertured portion 76 with the rod 38. As the upward swinging movement of the cover member 22 with the lever member 24 continues during the magazine opening stroke, the tensioning of the flexible member 74 will cause the apertured end portion 76 of the flexible member to move rearwardly along the guide rod 38 carrying the pusher 42 with it against the action of the spring 52. When the cover member 22 and lever member 24 reach a position of movement of approximately 45°, head portion 80 begins to slide along the surface of the cover member defining the slot 82. This sliding movement will continue until the head 80 moves into a position adjacent the rearward end of the slot, as shown in FIG. 3. When the head ends reach this position, subsequent movement through the magazine opening stroke results in the movement of the apertured end portion 76 rearwardly along the guide rod 38 until the pusher is moved thereby into its fully retracted staple stick loading position, as shown in FIG. 2.

When the cover member, together with the lever member, is moved through its magazine closing stroke, it will be noted that during the initial portion of the movement through this stroke, the pusher retracting member 74 will allow the pusher 42 to be moved forwardly by the action of the spring 52 until the staple stick engaging surfaces 44 engage the trailing staple of the staple stick disposed in the receiving chamber 28. As the magazine closing stroke continues, pusher 42 no longer moves and, likewise, the apertured end portion 76 of the pusher retracting member 74 likewise has no movement. The headed portion 80 of the flexible member 74, however, moves relatively within the space 84 so that when the magazine closing stroke is completed, the head portion 80 is disposed within the space 84 in a position forwardly of the pusher, the extent of the member 74 looping rearwardly and then forwardly. In this position, it will be noted that the space 84 is sufficiently large to accommodate freely the movement of the head 80 therein when the lever member 24 is disposed in its resiliently-biased limiting position with respect to the cover member, as shown in FIG. 1. When the lever member is actuated by virtue of a staple driving operation, space 84 is reduced so that the distance between the interior of the bight portion of the lever member and the associated surface of the cover member move closer together. During this movement, the head portion may be cocked into an angular position, the circular peripheral configuration of the head portion serving to accommodate such movement.

As the staple driving operations are repeatedly accomplished and the leading staple of the stick is driven, pusher 42 together with the apertured end portion 76 of the retracting member 74 is moved forwardly. Thus, the looped condition of the member 74 gradually changes as does the relative position of the head portion 80 within the space 84 until all of the staples are depleted and the retracting member 74 assumes the position shown in FIG. 1.

It can be seen that the configuration of the flexible member 74 readily lends itself to being formed by a molding operation rather than fabrication from tape or film. The folding or looping of the member is accomplished within the relatively large space 84 rather than to attempt to handle it in the top of the covered magazine as is the case with the prior art. In this way, integral connections can be made for the ends of the member which greatly facilitate the assembly thereof. While it is not contemplated that the member would ever break in operation, in the event that such break does occur, the tab 50 provides a convenient means for the operator to manually move the pusher 42 into its staple loading position against the action of the spring 52 when the cover member and lever member have been moved into their staple stick loading position.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a staple driving device comprising a magazine structure having means defining a drive track and means defining an elongated open top chamber leading to said drive track of a size to receive and support a staple stick therein, a staple stick pusher disposed within said chamber, means mounting said pusher within said chamber for generally rectilinear movement toward and away from said drive track, said mounting means including an elongated rod fixedly mounted in said magazine structure, said pusher having a sliding connection with said rod, spring means resiliently biasing said pusher in a direction toward said drive track, a top cover member mounted for pivotal movement between an operative position disposed in closing relation with the open top of said magazine chamber and a staple stick loading position displaced from said magazine chamber an arcuate extent sufficient to expose the open top thereof for convenient loading of a staple stick therein, a lever member having a staple driving element, means mounting said lever member for pivotal movement through (A) staple driving cycles each of which includes (1) a drive stroke during which a staple in said drive track is driven by said staple driving element from said drive track and (2) a return stroke, and (B) staple stick loading cycles each of which includes (1) a magazine opening stroke during which said cover member is moved with said lever member from the operative position thereof to the staple stick loading position thereof and (2) a magazine closing stroke during which said cover member is moved with said lever member from the staple stick loading position thereof to the operative position thereof, and elongated flexible pusher retracting means operatively connected with said pusher and said cover member for (A) effecting movement of said pusher in a direction away from said drive track into a stick loading position in response to the movement of said cover member with said lever member through said magazine opening stroke and (B) permitting said pusher member to be moved by the resilient bias of said spring means toward said drive track when said cover member is in said operative position, the improvement in combination therewith which comprises said pusher retracting means having one end portion thereof abuttingly engaging said pusher and formed with an aperture through which said rod extends.

2. A stapler comprising a base having a staple leg clinching anvil thereon, a magazine structure pivoted to said base having means defining a drive track movable toward and away from said anvil and means defining an elongated open top chamber leading to said drive track of a size to receive and support a staple stick therein, a staple stick pusher disposed within said chamber, means mounting said pusher within said chamber for generally rectilinear movement toward and away from said drive track, said mounting means including an elongated rod fixedly mounted in said magazine structure, said pusher having a sliding connection with said rod, spring means resiliently biasing said pusher in a direction toward said drive track, a top cover member mounted for pivotal movement between an operative position disposed in closing relation with the open top of said magazine chamber and a staple stick loading position displaced from said magazine chamber an arcuate extent sufficient to expose the open top thereof for convenient loading of a staple stick therein, a lever member having a staple driving element, means mounting said lever member for pivotal movement through (A) staple driving cycles each of which includes (1) a drive stroke during which (a) said magazine structure is moved with said lever member toward said base into engagement with a workpiece disposed therebetween and (b) a staple in said drive track is driven by said staple driving element from said drive track through the workpiece and into clinching relation to said anvil and (2) a return stroke, and (B) staple stick loading cycles each of which includes (1) a magazine opening stroke during which said cover member is moved with said lever member from the operative position thereof to the staple stick loading position thereof and (2) a magazine closing stroke during which said cover member is moved with said lever member from the staple stick loading position thereof to the operative position thereof, and elongated flexible pusher retracting means operatively connected with said pusher and said cover member for (A) effecting movement of said pusher in a direction away from said drive track into a stick loading position in response to the movement of said cover member with said lever member through said magazine opening stroke and (B) permitting said pusher member to be moved by the resilient bias of said spring means toward said drive track when said cover member is in said operative position, the improvement in combination therewith which comprises said pusher retracting means having one end portion thereof abuttingly engaging said pusher and formed with an aperture through which said rod extends.

3. The improvement as defined in claim 2, wherein said pusher retracting means comprises an elongated flexible member molded of plastic material, said one end portion formed with an aperture being molded as an integral part of said flexible member.

4. The improvement as defined in claim 2 or 3, wherein said pusher comprises an inverted U-shaped member having a central bight portion, said bight portion having a tab struck therefrom and bent downwardly so as to form an opening therein forwardly of the bent down tab, said tab having an aperture therein through which said rod extends, the abutting engagement between said pusher and said one end portion being constituted by the engagement of the latter with the forward surface of said bent down tab.

5. The improvement as defined in claim 4, wherein the bight portion of said pusher member has a forward tab struck therefrom and bent upwardly and providing a manually engageable projection by which said pusher member can be manually moved.

6. The improvement as defined in claim 4, wherein said pusher retracting means has an opposite end thereof formed with an enlarged head, said cover member having an elongated slot extending therethrough leading to said space, said pusher retracting means extending through said slot with said enlarged head being disposed within said space, said enlarged head having exterior surface means for (1) permitting passage of said head through said slot and into said space with said head oriented in a mounting relationship with respect to said slot and (2) preventing movement of said head outwardly through said slot with said head oriented in a normal operative relationship within said space as aforesaid.

7. The improvement as defined in claim 6, wherein said exterior surface means is of generally disk-like configuration having a generally circular periphery.

8. A stapler comprising a base having a staple leg clinching anvil thereon, a magazine structure pivoted to said base having means defining a drive track movable toward and away from said anvil and means defining an elongated open top chamber leading to said drive track of a size to receive and support a staple stick therein, a staple stick pusher disposed within said chamber, means mounting said pusher within said chamber for generally rectilinear movement toward and away from said drive track, spring means resiliently biasing said pusher in a direction toward said drive track, a top cover member mounted for pivotal movement between an operative position disposed in closing relation with the open top of said magazine chamber and a staple stick loading position displaced from said magazine chamber an arcuate extent sufficient to expose the open top thereof for convenient loading of a staple stick therein, a lever member having a staple driving element, means mounting said lever member for pivotal movement through (A) staple driving cycles each of which includes (1) a drive stroke during which (a) said magazine structure is moved with said lever member toward said base into engagement with a workpiece disposed therebetween and (b) a staple in said drive track is driven by said staple driving element from said drive track through the workpiece and into clinching relation to said anvil and (2) a return stroke, and (B) staple stick loading cycles each of which includes (1) a magazine opening stroke during which said cover member is moved with said lever member from the operative position thereof to the staple stick loading position thereof and (2) a magazine closing stroke during which said cover member is moved with said lever member from the staple stick loading position thereof to the operative position thereof, said lever member and said cover member defining a space above said cover member when the latter is in said operative position, and elongated flexible pusher retracting means operatively connected with said pusher and said cover member for (A) effecting movement of said pusher in a direction away from said drive track into a stick loading position in response to the movement of said cover member with said lever member through said magazine opening stroke and (B) permitting said pusher member to be moved by the resilient bias of said spring means toward said drive track when said cover member is in said operative position, the improvement in combination therewith which comprises said pusher retracting means having an end thereof formed with an enlarged head, said cover member having an elongated slot extending therethrough leading to said space, said pusher retracting means extending through said slot with said enlarged head being disposed within said space, said enlarged head having exterior surface means for (1) permitting passage of said head through said slot and into said space with said head oriented in a mounting relationship with respect to said slot and (2) preventing movement of said head outwardly through said slot with said head oriented in a normal operative relation within said space as aforesaid.

9. In a staple driving device comprising a magazine structure having means defining a drive track and means defining an elongated open top chamber leading to said drive track of a size to receive and support a staple stick therein, a staple stick pusher disposed within said chamber for generally rectilinear movement toward and away from said drive track, spring means resiliently biasing said pusher in a direction toward said drive track, a top cover member mounted for pivotal movement between an operative position disposed in closing relation with the open top of said magazine chamber and a staple stick loading position displaced from said magazine chamber an arcuate extent sufficient to expose the open top thereof for convenient loading of a staple stick therein, a lever member having a staple driving element, means mounting said lever member for pivotal movement through (A) staple driving cycles each of which includes (1) a drive stroke during which a staple in said drive track is driven by said staple driving element from said drive track and (2) a return stroke, and (B) staple stick loading cycles each of which includes (1) a magazine opening stroke during which said cover member is moved with said lever member from the operative position thereof to the staple stick loading position thereof and (2) a magazine closing stroke during which said cover member is moved with said lever member from the staple stick loading position thereof to the operative position thereof, said lever member and said cover member defining a space above said cover member when the latter is in said operative position, an elongated flexible pusher retracting means operatively connected with said pusher and said cover member for (A) effecting movement of said pusher in a direction away from said drive track into a stick loading position in response to the movement of said cover member with said lever member through said magazine opening stroke and (B) permitting said pusher member to be moved by the resilient bias of said spring means toward said drive track when said cover member is in said operative position, the improvement in combination therewith which comprises said pusher retracting means having an end thereof formed with an enlarged head, said cover member having an elongated slot extending therethrough leading to said space through which said pusher retracting means extends, said enlarged head being disposed in said space and having length and width dimensions such as to prevent passage thereof outwardly through said slot and a thickness dimension of a size to permit said enlarged head to be inserted through said slot when said enlarged head is oriented with its thickness aligned with the width of said slot.

* * * * *